United States Patent [19]

Lindsey

[11] 4,008,114

[45] Feb. 15, 1977

[54] MACHINE FOR WRAPPING TAPE ON A PIPE INCLUDING IMPROVED MEANS OF CONTROLLING THE TENSION ON THE TAPE

[75] Inventor: Clifford P. Lindsey, Sapulpa, Okla.

[73] Assignee: Midwestern Manufacturing Company, Tulsa, Okla.

[22] Filed: Sept. 15, 1975

[21] Appl. No.: 613,337

[52] U.S. Cl. ..... 156/392; 156/494; 188/72.7; 242/75.45

[51] Int. Cl.[2] ..... B65H 81/00

[58] Field of Search ..... 156/392, 494, 429; 242/75.45; 188/72.7, 72.8, 72.9

[56] References Cited

UNITED STATES PATENTS

| | | | |
|---|---|---|---|
| 2,588,525 | 3/1952 | Hertenstein | 242/75.45 X |
| 2,770,284 | 11/1956 | Myrick | 156/392 |
| 3,024,873 | 3/1962 | Wilkinson | 188/72.8 X |
| 3,115,217 | 12/1963 | Butler | 188/72.7 X |

*Primary Examiner*—David A. Simmons
*Attorney, Agent, or Firm*—Head, Johnson & Chafin

[57] ABSTRACT

A machine for wrapping tape on a pipe including an improved means of controlling the tension on the tape, the machine having a bracket supported for rotation around the pipe and axial advancement along the pipe, a spindle rotatably supported to the bracket, tape to be wrapped about the pipe being placed in the form of a roll on the spindle, a brake means affixed to the spindle, a brake shoe supported to the bracket arranged to contact the brake member to impart variable frictional force thereagainst, a follower arm having the inner end pivotally supported to the bracket and the outer end in engagement with the external periphery of the roll of tape mounted on the spindle, and means actuated by the follower arm of increasing the frictional contact of the brake shoe with the brake member in proportion to the diameter of the roll of tape on the spindle.

3 Claims, 5 Drawing Figures

MACHINE FOR WRAPPING TAPE ON A PIPE INCLUDING IMPROVED MEANS OF CONTROLLING THE TENSION ON THE TAPE

BACKGROUND AND SUMMARY OF THE INVENTION

In order to reduce galvanic action and oxidation on pipe which is buried in the ground it is a practice to wrap pipe with a nonconductive impervious material. To facilitate wrapping the pipe machines have been developed which are positioned on the pipe, the machines including a spindle for receiving a roll of tape. As the machine is rotated around the pipe it automatically advances along the pipe. One end of the tape is affixed to the pipe and as the machine rotates around the pipe the tape is unwound from the spoon and wound onto the pipe. The tape is wound so that it overlaps to form a continuous covering around the pipe.

In order to properly affix the tape to the pipe, a certain amount of tension must be applied to the tape. The tension force required varies according to several factors, including the diameter of the pipe, the width of the tape, the type and thickness of the tape and so forth. If too little tension is applied on the tape as it is wound on the pipe it will not firmly seal against the pipe with the possibility of leaving air holes by which galvanic action may occur or contact of the pipe may be had with water or the earth, resulting in more rapid deterioration of the pipe. On the other hand, if the tension is too great, the tape will be stretched to a point where either the tape breaks, or the thickness of the tape applied to the pipe will be decreased so that the required thickness specifications are not obtained.

In order to maintain tension on the tape it has been a practice to apply a braking force on the spindle to which the roll of tape is supported so as to resist the unrolling of the tape as the machine rotates around the pipe. If the diameter of the roll of tape remains constant such arrangement would be completely satisfactory. Since the diameter of a roll of tape constantly changes as the tape is applied to the pipe, starting out with the full diameter of the roll of tape as it is placed on the spindle and decreases to the minimum diameter of the tape spool as the last portion of the tape is used, a preselected fixed amount of tension against the rotation of the spindle on which the tape roll is positioned results in an uneven amount of tension being applied to the tape. It can be seen that the moment arm of a full roll of tape is much greater than that of a near empty roll of tape. Therefore, with fixed friction on the spindle, much more tension is supplied to the tape when the spool is nearly empty than is applied when a full spool is first placed on the spindle.

It is therefore an object of this invention to provide a machine for wrapping tape on a pipe including improved means of controlling the tension on the tape.

More particularly an object of this invention is to provide a machine for wrapping tape on a pipe including means of controllably varying the tension applied to resist the rotation of the spool on which the tape is placed, the tension being varied so that it is proportional to the diameter of the roll of tape on the spindle so that thereby the tension applied to the tape remains relatively constant as the tape is removed from the roll.

These general objects, as well as other and more specific objects of the invention will be fulfilled in the the following description and claims, taken in conjunction with the attached drawings.

DESCRIPTION OF VIEWS

SUMMARY OF THE INVENTION

A machine is disposed for wrapping tape on a pipe including a brake positioned for simultaneous rotation around the pipe and axial advancement along the pipe, a spindle rotatably is supported to the bracket and adapted for receiving a roll of tape thereon, a brake member is affixed to and rotated with the spindle, a brake shoe is affixed to the bracket and arranged to contact the brake member to impart variable frictional force thereagainst, a follower arm has an inner end pivotally supported to the bracket and has the outer end in engagement with the external periphery of a roll of tape mounted on the spindle so that the angle of the follower arm is determined by the diameter of the tape roll on the spindle. A brake cam member is rotatably positioned by the follower arm and cam followers are acted on by the cam member to force the brake shoe into contact with the brake member with a friction imparting force dependent upon the angle of the follower arm which, in turn, is dependent on the diameter of the roll of tape so that greater friction is applied when the diameter of the roll of tape is large to thereby maintain relatively constant tension on the tape wound on the pipe.

DETAILED DESCRIPTION

Figure 1:
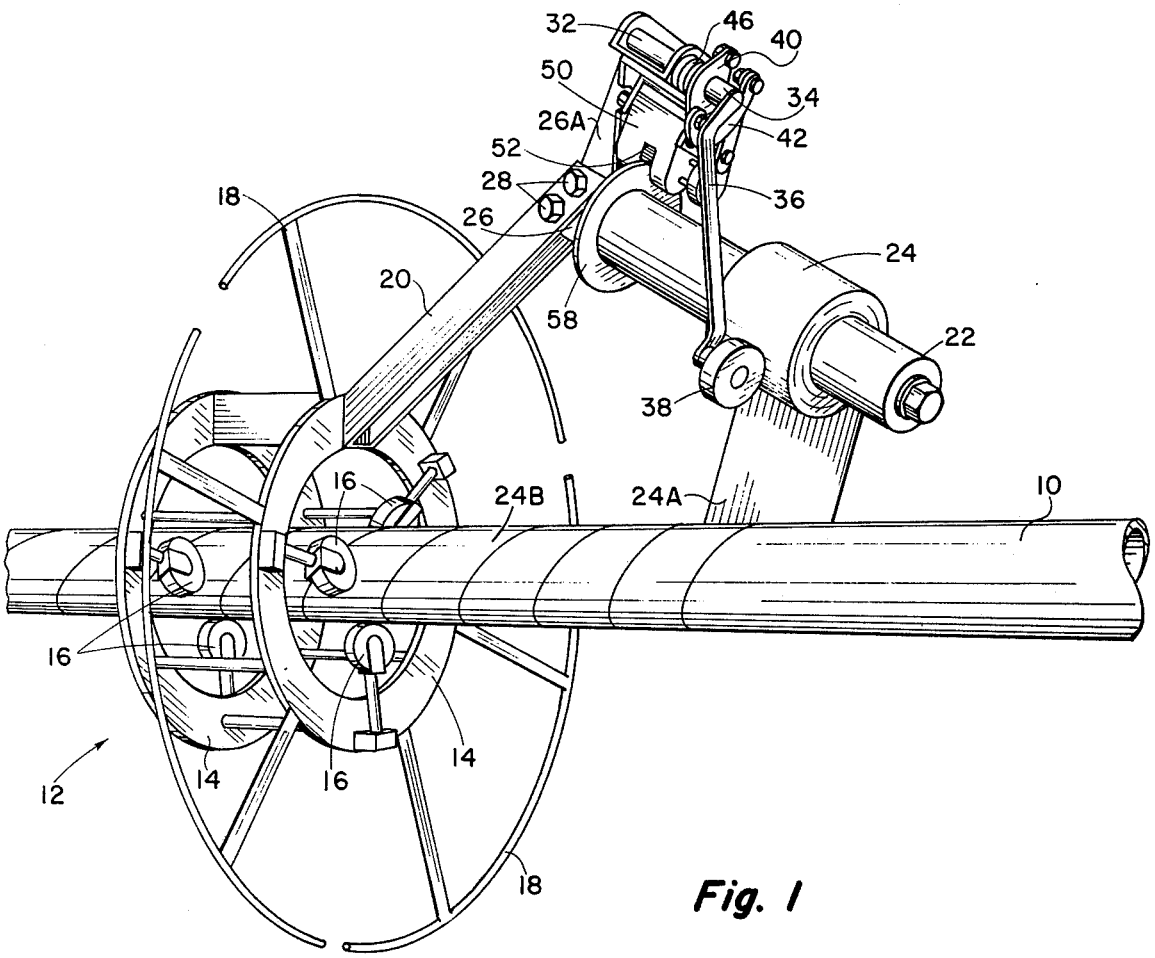
FIG. 1 is an isometric view of a machine for wrapping tape on a pipe including improved means of controlling the tension on the tape.

Referring to the drawings and first to FIG. 1 an isometric view is shown of one embodiment of a machine for wrapping tape on a pipe. The pipe is identified by FIG. 10. Positioned on pipe 10 is a machine framework generally indicated by the numeral 12 which is adapted for rotation about the pipe 10 and for axial advancement along the pipe. The machine framework 12 is not directly related to the improvements comprising the present invention, since it is well known in the art and generally consists of circular base portions 14 having rollers 16 which are set at an angle so that as the machine rotates around the pipe it advances axially along the pipe. Circumferential hand rails 18 extend from the base portions 14 to provide a manual means for rotation of the machine framework about the pipe 10. In more sophisticated devices the machine framework 12 is rotated automatically by a motor or an engine and this invention can be employed regardless of the method by which a machine framework 12 is rotated about the pipe 10.

Extending from the base portions 14 is an arm 20. Rotatably supported to the outer end of the arm 20 is a spindle 22 which is adapted to receive a roll of tape 24 thereon. As the machine framework 12, including arm 20 and spindle 22 is rotated about pipe 10, tape 24A is pulled from the roll and wound in helical configuration about the pipe 10. Tape which has been wound on the pipe is identified by the numeral 24B.

As previously indicated, in order to assure uniformity in the application of the tape to the total periphery of the pipe 10 it is necessary that a preselected amount of tension be applied to the tape 24A as it is wound about the pipe. The amount of tension will vary according to the diameter of the pipe 10, the width of tape, and the thickness and composition of the tape. It can further be seen that with a preselected amount of friction resisting the rotation of spindle 22, the amount of tension applied to tape 24A is dependent upon the diameter of the roll of tape 24. When tape roll 24 is large in diameter as occurs when a fresh roll of tape is placed on the spindle, a selected amount of friction resisting the rotation of spindle 22 will impart a substantially smaller tension to taper 24A than will occur when the tape roll 24 is small in diameter. The present invention is directed towards means of maintaining tension on the taper 24A at a substantially constant level regardless of the diameter of the roll of tape 24.

Figure 2:
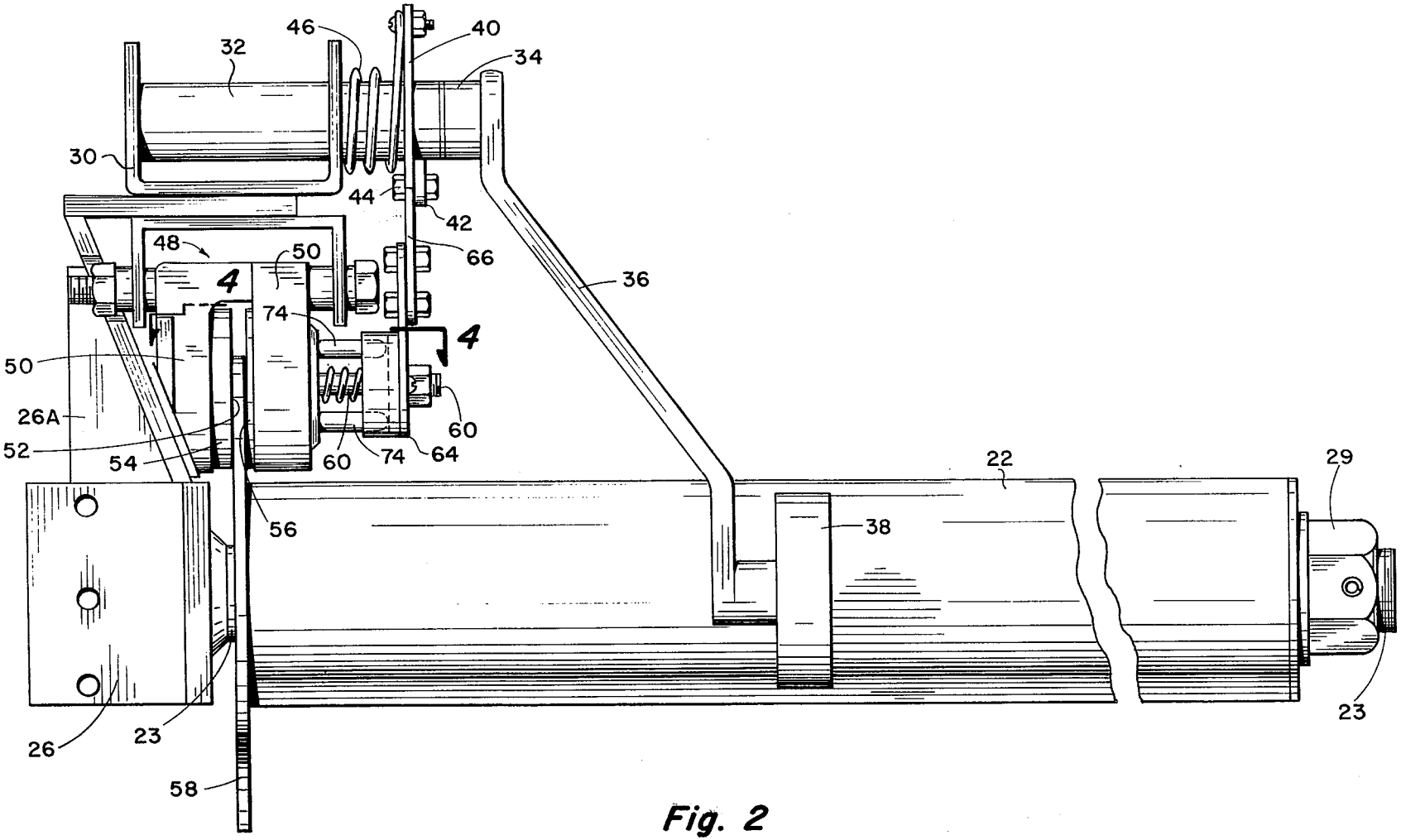
FIG. 2 is an enlarged elevational view of the tape spindle and braking means as employed on a machine for wrapping tape on a pipe according to this invention.

Referring next to FIG. 2 spindle 22 is shown without a roll of tape thereon. The spindle is rotatably supported on a shaft 23 affixed to a bracket 26 which in turn is affixed to the outer end of the arm 20, by means of bolts 28 as shown in FIG. 1. A nut 29 retains spindle 22 on shaft 23. Bracket 26 includes an upstanding portion 26A. A U-shaped support 30 has a bushing 32 thereon which in turn rotatably receives a reduced diameter portion (not shown) of a shaft 34. Affixed to the shaft 34 is the inner end of a follower arm 36. At the outer end of the follower arm is a roller 38 which engages the exterior periphery of a roll of tape positioned on the spindle 22 as shown in FIG. 1.

Affixed to the shaft 34 is a plate 40 and in turn, one end of a first linkage is pivotally attached to the plate 40 by means of a bolt 44. A spring 46 is wound about shaft 34, the spring having one end in engagement with the plate 40 and the other in engagement with support 30, the spring being oriented such that biasing force is applied to urge the arm 36 in the direction towards spindle 22 so that roller 38 always contacts the surface of a roll of tape 24 positioned on the spindle 22.

Supported to the bracket upper portion 26A is a brake shoe means generally indicated by the numeral 48. The brake shoe means includes a housing 50 having a slot 52 therein. The housing 50 includes a recess to either side of the slot receiving a fixed brake pad 54 on one side of the slot 52 and a movable brake pad 56 on the other side of the slot.

Affixed to the spindle 22 at the inner end thereof adjacent bracket 26 is a brake member, in the form of a disc 58. The disc 58 is coaxial with the spindle 22 and rotates with it. The outer peripheral portion of disc 58 is received within the slot 52, brake pads 54 and 56 being on either side of the disc.

Figure 3:
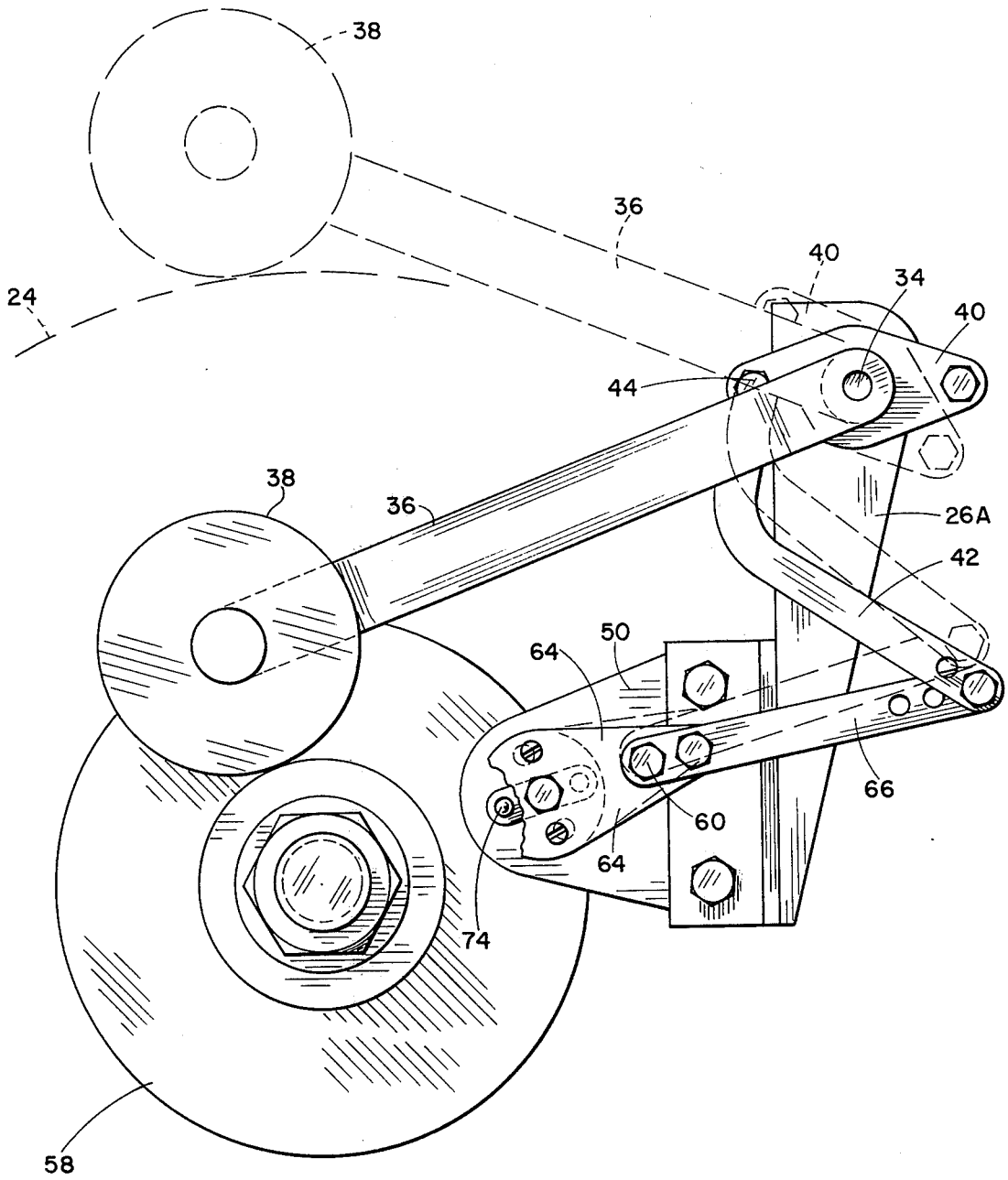
FIG. 3 is an end view of the spindle and braking means.

By means of a bolt 60 extending from the brake housing 50 a brake cam member 62 is rotatably supported. Extending from the cam member is a plate 64 and the outer end of plate 64 is attached to a second linkage 66 which is pivotally secured at its other end to the first linkage 42 (see FIG. 3).

Figure 4:
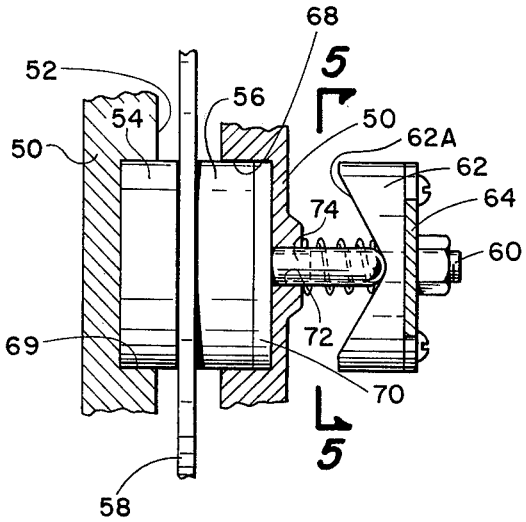
FIG. 4 is a cross-sectional view taken along the line 4—4 of FIG. 2 showing details of the braking system.
Figure 5:
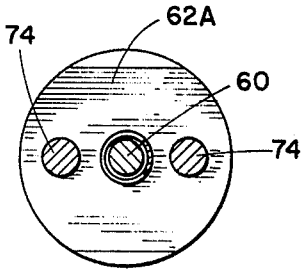
FIG. 5 is a cross-sectional view taken along the line 5—5 of FIG. 4 showing the face of the brake cam.

Referring to FIG. 4 the brake housing 50 is shown having a recess 68 therein in which the movable brake shoe 56 is positioned and a recess 69 in which fixed brake pad 54 is positioned. Behind the brake pad 56 is a brake plate 70 which is longitudinally positionable in the recess 68. To either side of bolt 60 there is an opening 72, only one of which is seen in FIG. 4. Positioned in each opening 72 is a cam follower 74, the inner end of which engages the brake plate 70.

Brake cam member 62 has an inner cam surface 62A which, as cam member 62 is rotated about bolt 60, serves to displace the cam followers 74. As the cam plate 62 is rotated cam followers 74 push inwardly against the brake plate 70 which in turn displaces the movable brake pad 56 to apply increased frictional engagement with the outer periphery portion of disc 58.

OPERATION

To position a roll of tape 24 on spindle 22 the cam follower arm 38 is raised and the tape slid in place. The cam follower arm is then released and by the force of spring 46 it will return so that roller 38 engages the periphery of the tape roll 24. According to the angle of displacement of arm 36 by way of linkage 42 and 66, brake cam member 62 is rotated. The rotation thereof causes the cam surface 62A to act upon cam followers 74, urging the movable brake pad 56 into engagement with disc 58. This frictional engagement, which serves to displace the disc slightly so that friction is also imparted by the fixed brake pad 54, resists rotation of spindle 22. As the machine framework 12 is rotated about the pipe 10, tape 24A is unrolled from the tape roll 24 and wound about the pipe 10. As tape 24A is pulled from the tape roll spindle 22 is rotated against the resistance imparted by the frictional engagement of the brake pads 54 and 56 against disc 58.

When the tape roll 24 is full, that is, of maximum diameter, the follower arm 36 will be displaced the maximum extent relative to the spindle 22 and, by the linkages 42 and 66, the brake cam member 62 will likewise be displaced to a maximum amount, applying maximum frictional engagement of brake pads 54 and 56 with disc 58. As the tape roll becomes smaller, the force applied by way of the cam surface 62A to movable brake pad 56 decreases. By proper selection of the relationship the length of linkages and the configuration of the brake cam surface 62A, the amount of frictional drag applied to spindle 22 can be adjusted so that the drag decreases at a rate proportional to the decrease in diameter of the tape roll 24 to thereby apply a substantially even tension on the tape 24A as it is applied to the pipe.

In the illustration of FIG. 1 only one arm 20 and one spindle 22 with its braking mechanism is shown. Obviously, this creates an imbalance on the machine framework 12 and for this reason it is customary, particularly on larger sizes of pipe 10, to use a framework having two arms 20 and spindles extending therefrom in balanced relationship. Whether one, two or more spindles are utilized on the machine framework 12 is not relevant to the invention since the braking system will function in the same way.

While the invention has been described with a certain degree of particularity it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A machine for wrapping tape on a pipe including improved means of controlling the tension on the tape, comprising:

a bracket supported for simultaneous rotation around and axial advancement along a pipe;

a spindle rotatably supported to the bracket and adapted for receiving a roll of tape thereon;

a brake disc coaxially mounted and rotated with said spindle;

a brake housing having a slot therein receiving the outer peripheral area of said disc;

a movable brake pad;

an opening in said brake housing having a said brake pad longitudinally positionable therein, one surface of the brake pad contacting said disc;

a rotatable cam plate having a cam surface thereon, the cam plate being supported in proximity to said brake pad;

a longitudinally positionable cam follower having one end in engagement with said brake pad and the other in engagement with said cam plate, the pressure exerted by said cam follower pushing said brake pad into increased frictional contact with said disc being determined by the rotational position of said cam plate;

a follower arm having the inner end pivotally supported to said bracket and having the outer end in engagement with the external periphery of a roll of tape mounted on said spindle;

a first linkage arm extending from said cam plate normal to the rotational axis thereof; and a second linkage connected to said follower arm adjacent the inner pivoted end, the outer ends of the first and second linkage arms being pivotally secured to each other, whereby increased frictional contact of said brake pad with said brake disc is achieved in proportion to the diameter of the roll of tape on said spindle.

2. A machine according to claim 1 wherein said cam plate is coaxially supported relative to said brake pad and including two said cam followers diametrically positioned to either side of the rotational axis of said cam plate.

3. A machine for wrapping tape on a pipe according to claim 1 including a roller supported on the outer end of said follower arm to engage the roll of tape positioned on said spindle.

* * * * *